US010837450B2

(12) United States Patent
Cornelius et al.

(10) Patent No.: US 10,837,450 B2
(45) Date of Patent: Nov. 17, 2020

(54) COMPRESSOR ROTOR BLADE, COMPRESSOR, AND METHOD FOR PROFILING THE COMPRESSOR ROTOR BLADE

(71) Applicant: Siemens Aktiengesellschaft, Munich (DE)

(72) Inventors: Christian Cornelius, Sprockhövel (DE); Christoph Starke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 134 days.

(21) Appl. No.: 16/075,731

(22) PCT Filed: Jan. 11, 2017

(86) PCT No.: PCT/EP2017/050453

§ 371 (c)(1),
(2) Date: Aug. 6, 2018

(87) PCT Pub. No.: WO2017/137201

PCT Pub. Date: Aug. 17, 2017

(65) Prior Publication Data

US 2019/0048880 A1 Feb. 14, 2019

(30) Foreign Application Priority Data

Feb. 10, 2016 (EP) ..... 16155063

(51) Int. Cl.
*F04D 21/00* (2006.01)
*F04D 29/32* (2006.01)
(Continued)

(52) U.S. Cl.
CPC ..... *F04D 21/00* (2013.01); *F04D 19/00* (2013.01); *F04D 29/324* (2013.01);
(Continued)

(58) Field of Classification Search
CPC .... F04D 29/324; F04D 29/384; F04D 29/681; F04D 21/00; F04D 19/00
See application file for complete search history.

(56) References Cited

U.S. PATENT DOCUMENTS 2,934,259 A 4/1960 Hausmann
6,116,856 A * 9/2000 Karadgy ..... B64C 11/00 29/888.025

(Continued)

FOREIGN PATENT DOCUMENTS

CN 102459818 A 5/2012
CN 102483072 A 5/2012

(Continued)

OTHER PUBLICATIONS

EP search report dated Aug. 8, 2016, for EP patent application No. 16155063.7.

(Continued)

*Primary Examiner* — David E Sosnowski
*Assistant Examiner* — Hakeem M Abdellaoui
(74) *Attorney, Agent, or Firm* — Wolter Vandyke Davis, PLLC

(57) ABSTRACT

A compressor rotor blade for an axial-type compressor has a blade profile having a transonic section and a profile section which extends in the transonic section and has concave and convex suction-side regions on the suction side, the convex suction-side region arranged downstream of the concave suction-side region, and has convex and concave pressure-side regions on the pressure side, the concave pressure-side region arranged downstream of the convex pressure-side region. Curvature progressions on the pressure side and on the suction side are both applied in a continuous manner over a profile chord of the profile section, the positions of the minimum values of the curvature progressions deviate from each other by not more than 10% of the length of the profile chord, and the positions of the maximum values of the curvature progressions deviate from each other by not more than 10% of the length of the profile chord.

16 Claims, 4 Drawing Sheets

(51) Int. Cl.
*F04D 29/68* (2006.01)
*F04D 19/00* (2006.01)
*F04D 29/38* (2006.01)

(52) U.S. Cl.
CPC ..... *F04D 29/384* (2013.01); *F04D 29/681* (2013.01); *F05D 2240/302* (2013.01); *F05D 2240/305* (2013.01); *F05D 2240/306* (2013.01)

(56) References Cited

U.S. PATENT DOCUMENTS 7,195,456 B2 * 3/2007 Aggarwala ..... F01D 5/145 415/208.2
8,911,215 B2 * 12/2014 Cornelius ..... F04D 29/324 416/242
9,353,764 B2 * 5/2016 Henner ..... F04D 29/386
2012/0093637 A1 * 4/2012 Takahashi ..... F04D 29/324 415/208.1
2012/0230834 A1 * 9/2012 Cornelius ..... F01D 5/141 416/243
2014/0356154 A1 * 12/2014 Iliopoulou ..... F04D 29/384 415/208.1
2014/0356156 A1 12/2014 Sonoda et al.
2015/0300178 A1 10/2015 Osako et al.
2018/0100399 A1 * 4/2018 Peeren ..... F04D 29/324

FOREIGN PATENT DOCUMENTS

DE 102013209966 A1 12/2014
EP 3088663 A1 * 11/2016 ..... F01D 5/141
FR 2551145 A1 3/1985
JP H08121390 A 5/1996

OTHER PUBLICATIONS

International Search Report dated Apr. 13, 2017, for PCT/EP2017/050453.

* cited by examiner

COMPRESSOR ROTOR BLADE, COMPRESSOR, AND METHOD FOR PROFILING THE COMPRESSOR ROTOR BLADE

CROSS REFERENCE TO RELATED APPLICATIONS

This application is the US National Stage of International Application No. PCT/EP2017/050453 filed Jan. 11, 2017, and claims the benefit thereof. The International Application claims the benefit of European Application No. EP16155063 filed Feb. 10, 2016. All of the applications are incorporated by reference herein in their entirety.

FIELD OF INVENTION

The invention relates to a compressor rotor blade and to a method for profiling the compressor rotor blade.

BACKGROUND OF INVENTION

A compressor of axial design has at least one rotor blade ring with a plurality of compressor rotor blades for compressing a working medium. The compressor rotor blade has a radially inner subsonic section, in which the compression takes place by means of a deflection of the flow of the working medium. Furthermore, the compressor rotor blade has a transonic section, in which the compression takes place predominantly by means of a compression shock, in the case of which the working medium is retarded from supersonic speed to subsonic speed.

Losses in the flow of the working medium in the transonic section are produced, for example, in the compression shock and as a result of shedding of the boundary layer on the compressor rotor blade in the region of the compression shock. The losses bring about a reduction in the degree of efficiency of the compressor.

SUMMARY OF INVENTION

It is therefore an object of the invention to provide a compressor rotor blade, a compressor having the compressor rotor blade, and a method for profiling the compressor rotor blade, by way of which an increase in the degree of efficiency of the compressor which has the compressor rotor blade can be achieved.

The compressor rotor blade according to the invention for a compressor of axial design has a blade profile which has a transonic section, and a profile section of the blade profile, which profile section extends in the transonic section and, on its suction side, has a concave suction side region and a convex suction side region which is arranged downstream of the concave suction side region, and which, on its pressure side, has a convex pressure side region and a concave pressure side region which is arranged downstream of the convex pressure side region, a curvature progression on the pressure side of the profile section and a curvature progression on the suction side of the profile section being constant in each case plotted over a profile chord of the profile section, the positions of the minimum values of the curvature progressions differing from one another by no more than 10% of the length of the profile chord, and the positions of the maximum values of the curvature progressions differing from one another by no more than 10% of the length of the profile chord, the minimum values multiplied by the length of the profile chord being from −1.2 to −0.5, and the maximum values multiplied by the length of the profile chord being from 1.5 to 4.

The method according to the invention for profiling a compressor rotor blade for a compressor for compressing a working medium of axial design, which compressor has a rotor blade row with the compressor rotor blades, the compressor rotor blades having a blade profile with a transonic section, has the following steps: providing of a geometric model of the blade profile, the blade profile having a profile section which extends in the transonic section, and the rotor blade row being set up such that, in the case of a nominal operating condition of the compressor, a compressor shock sets in, in the case of which the working medium is retarded from supersonic speed to subsonic speed; fixing of boundary conditions for a flow which flows around the blade and occurs in the case of the nominal operating condition; changing of the profile section in such a way that the suction side has a concave suction side region and a convex suction side region which is arranged downstream of the concave suction side region, and which, on its pressure side, has a convex pressure side region and a concave pressure side region which is arranged downstream of the convex pressure side region, a curvature progression on the pressure side of the profile section and a curvature progression on the suction side of the profile section being constant in each case plotted over a profile chord of the profile section, the positions of the minimum values of the curvature progressions differing from one another by no more than 10% of the length of the profile chord, and the positions of the maximum values of the curvature progressions differing from one another by no more than 10% of the length of the profile chord, the minimum values multiplied by the length of the profile chord being from −1.2 to −0.5, and the maximum values multiplied by the length of the profile chord being from 1.5 to 4, the convex suction side region being arranged at least partially upstream of a compression shock which is exhibited by a flow which sets in in the compressor in the case of the boundary conditions, as a result of which, in relation to the length of the profile chord, the compression shock is arranged downstream of a compression shock which would be exhibited by a flow which would set in in the case of the geometric model before the profile section is changed and in the case of the nominal operating condition.

It has been found that the compressor having the compressor rotor blade according to the invention and/or having the compressor rotor blade which is profiled by way of the method according to the invention has a higher degree of efficiency in the case of an at least identical operating range than a compressor having the conventional compressor rotor blade. In addition, the Mach numbers on the suction side of the compressor rotor blade according to the invention upstream of the compression shock are lower than on the suction side of the conventional compressor rotor blade. In this way, shedding of the flow on the suction side of the compressor rotor blade according to the invention is less probable than in the case of the conventional compressor rotor blade. In addition, the compressor rotor blade according to the invention can be configured with a shorter length of its profile chord than is the case in the conventional compressor rotor blade, without losses in the degree of efficiency or a reduction of the working range being accepted as a result.

It is advantageous that the curvature progression multiplied by the length of the profile chord has a maximum value which is from 2 to 4 in the convex suction side region, and the curvature progression multiplied by the length of the profile chord has a maximum value which is from 1.5 to 2.5 in the concave pressure side region.

It is advantageous that the point of the concave suction side region with the minimum curvature in the case of a perpendicular projection onto the profile chord of the profile section defines a projection point on said profile chord, which projection point is spaced apart from the front edge of the profile section by from 40% to 80%, in particular from 60% to 75%, of the length of the profile chord. It is advantageous that the point of the convex suction side region with the maximum curvature in the case of a perpendicular projection onto the profile chord of the profile section defines a projection point on said profile chord, which projection point is spaced apart from the front edge of the profile section by from 70% to 95%, in particular from 80% to 90%, of the length of the profile chord. The degree of efficiency of the compressor can be increased further by way of each of said measures.

It is advantageous that the thickness of the profile section at all points of the profile section perpendicularly with respect to the profile chord is shorter than 2.5% of the length of the profile chord.

The compressor according to the invention for compressing a working medium has a rotor blade row which has the compressor rotor blades, the rotor blade row being set up such that, in the case of a nominal operating condition of the compressor, a precompression of the working medium takes place upstream of a compression shock, at which the working medium is retarded from supersonic speed to subsonic speed, and upstream of a flow duct which is delimited by two adjacent compressor rotor blades.

It is advantageous that the profile section lies on a cylindrical surface, the axis of which coincides with the axis of the compressor, on a conical surface, the axis of which coincides with the axis of the compressor, on an $S_1$ flow surface of the compressor, or in a tangential plane of the compressor. The $S_1$ flow surface extends in the circumferential direction and in the axial direction of the axial flow machine and describes a surface which is followed by an idealized flow.

The camber line of the profile section is advantageously shifted when said profile section is changed, in particular only the camber line is shifted. This advantageously achieves a situation where the width of the duct remains unchanged between two compressor rotor blades which are arranged adjacently in a rotor blade ring. It is advantageous that the geometric model, before the change of the profile section, is of exclusively concave configuration on the pressure side of said profile section and/or is of exclusively convex configuration on the suction side of said profile section.

It is advantageous that the profile section is changed in such a way that the progression of the curvature has a maximum value in the convex suction side region, which maximum value is greater than the maximum value of the progression of the curvature in the corresponding region of the conventional compressor rotor blade. The profile section is advantageously changed in such a way that the progression of the curvature multiplied by the length of the profile chord has a maximum value which is from 2 to 4 in the convex suction side region, and the progression of the curvature multiplied by the length of the profile chord has a maximum value which is from 1.5 to 2.5 in the concave pressure side region. It is advantageous that the rotor blade row is designed in such a way that it has a maximum isentropic Mach number of 1.4, in particular of at most 1.3, in the case of the nominal operating conditions. It is advantageous that the profile section is changed in such a way that the point of the concave suction side region with the minimum curvature in the case of a perpendicular projection onto the profile chord of the profile section defines a projection point on said profile chord, which projection point is spaced apart from the front edge of the profile section by from 40% to 80% of the length of the profile chord. The degree of efficiency of the compressor can be increased further by way of each of said measures.

BRIEF DESCRIPTION OF THE DRAWINGS

In the following text, the invention will be described in greater detail using the appended diagrammatic drawings and computationally determined data. In the drawings.

DETAILED DESCRIPTION OF INVENTION

Figure 1:
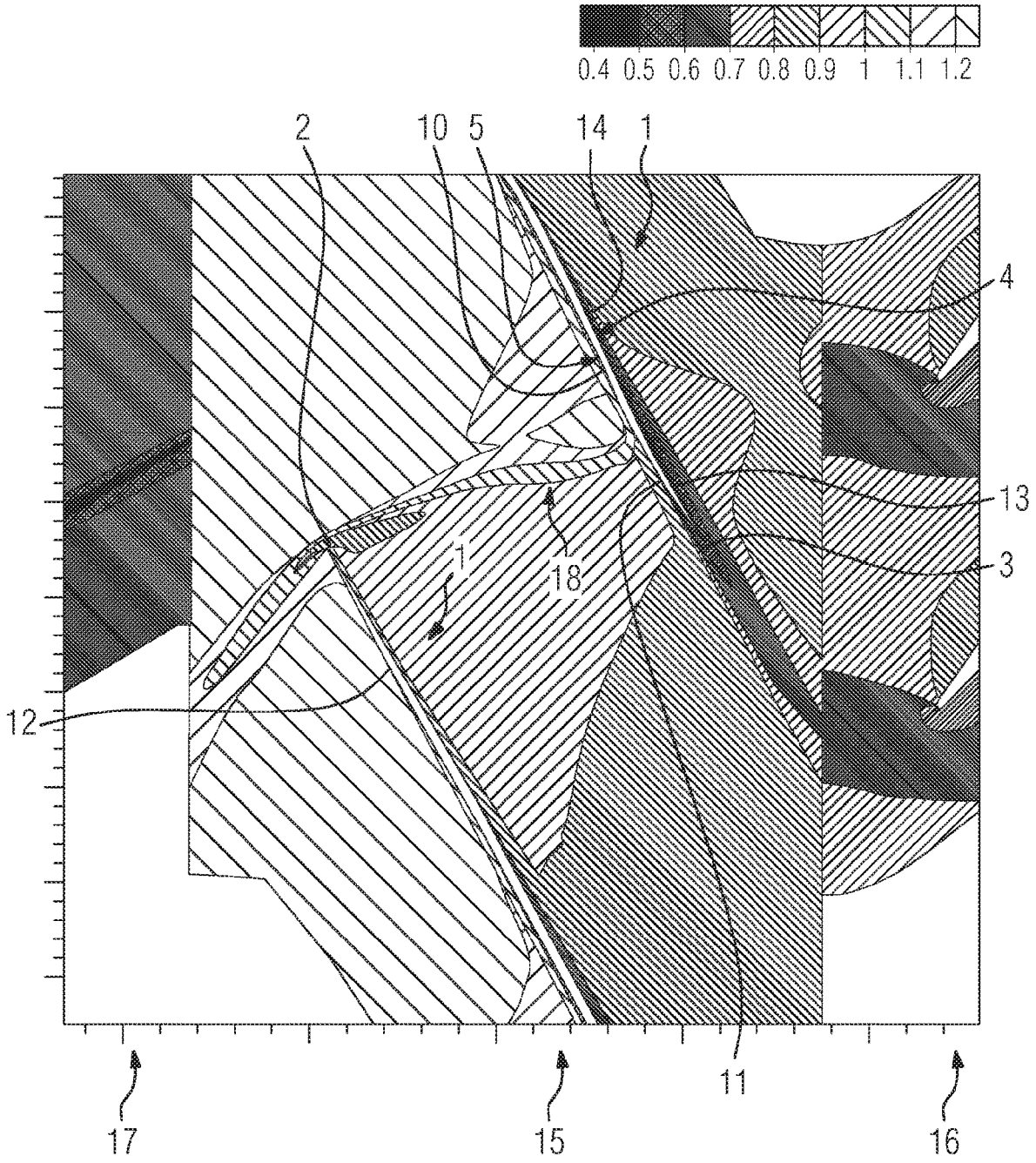
FIG. 1 shows the compressor rotor blade according to the invention with a computationally determined flow field.
Figure 3:
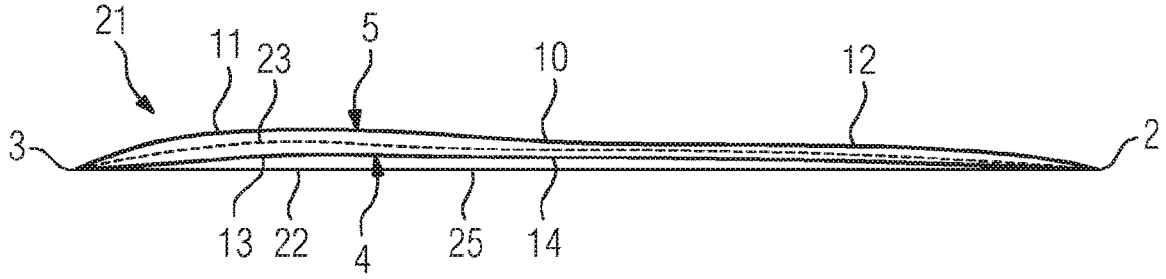
FIG. 3 shows a profile section of the compressor rotor blade according to the invention.

As can be seen from FIGS. 1 and 3, a compressor rotor blade 1 for a compressor of axial design has a blade profile. The blade profile has a radially inner subsonic section and a radially outer transonic section, only the transonic section being shown in FIGS. 1 and 3. The blade profile has a profile section 21 which extends in the transonic section. For example, the profile section 21 lies on a cylindrical surface, the axis of which coincides with the axis of the compressor, on a conical surface, the axis of which coincides with the axis of the compressor, on an $S_1$ flow surface of the compressor, or in a tangential plane of the compressor.

The profile section 21 has a front edge 2, a rear edge 3, a pressure side 4 and a suction side 5. In FIG. 3, a profile chord 22 is illustrated, in addition, which profile chord 22 extends as a straight line from the front edge 2 as far as the rear edge 3. Furthermore, FIG. 3 shows a camber line 23 which extends from the front edge 2 as far as the rear edge 3 and is situated at all times centrally between the pressure side 4 and the suction side 5 in a direction perpendicularly with respect to the profile chord 22.

FIG. 1 shows a two-dimensional flow distribution of a working medium which flows in the compressor, in a region of the compressor. FIG. 1 shows a guide blade row 15 having the compressor rotor blades 1, a guide blade row 16 which is downstream of the rotor blade row 15, and a guide blade row 17 which is upstream of the rotor blade row 15. On its suction side 5, the profile section 21 has a concave suction side region 10 which is arranged at least partially upstream of a compression shock 18 which is exhibited by a flow which sets in in the compressor in the case of a nominal operating condition of the compressor. In FIG. 1, the compression shock 18 is arranged in those regions of the flow, in which the Mach number decreases from higher than 1 to lower than 1. In addition, FIG. 1 shows that, in the case of the nominal operating condition of the compressor, a precompression of the working medium takes place upstream of the compression shock 18 and upstream of a flow duct which is delimited by two adjacent compressor rotor blades 1.

As a result of the concave suction side region, the compression shock 18 is arranged, in relation to the length of the profile chord 22, downstream of a compression shock which would be exhibited by a flow which would set in in the case of a conventional compressor rotor blade which can differ from the compressor rotor blade 1 in that it is of exclusively convex configuration on its suction side 5, and in the case of the nominal operating condition.

Figure 2:
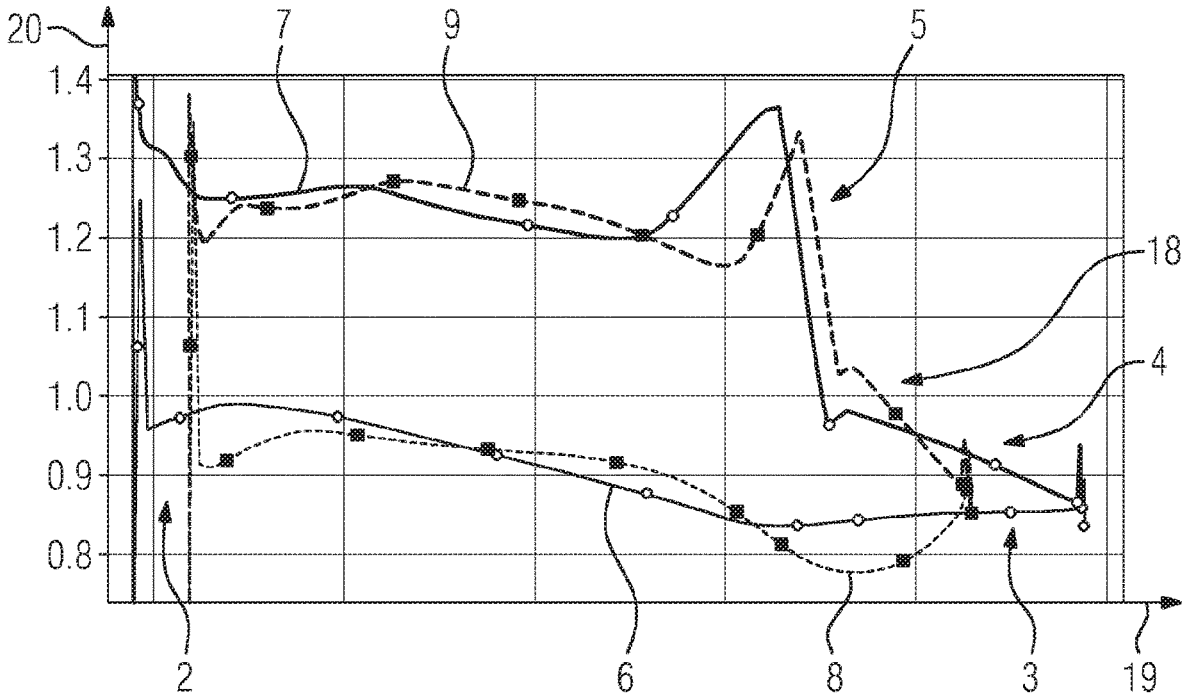
FIG. 2 shows Mach number progressions on the conventional compressor rotor blade and on the compressor rotor blade according to the invention.

FIG. 2 shows a comparison of the Mach number progressions on the compressor rotor blade 1 and the Mach number progressions on the conventional compressor rotor blade. A point on the profile chord 22 of the profile section 21 is plotted on the horizontal axis 19, and the Mach number is plotted on the vertical axis 20. The designation 6 denotes the Mach number progression on the pressure side of the conventional compressor rotor blade, the designation 7 denotes the Mach number progression on the suction side of the conventional compressor rotor blade, the designation 8 denotes the Mach number progression on the pressure side 4 of the compressor rotor blade 1, and the designation 9 denotes the Mach number progression on the suction side 5 of the compressor rotor blade 1.

Figure 5:
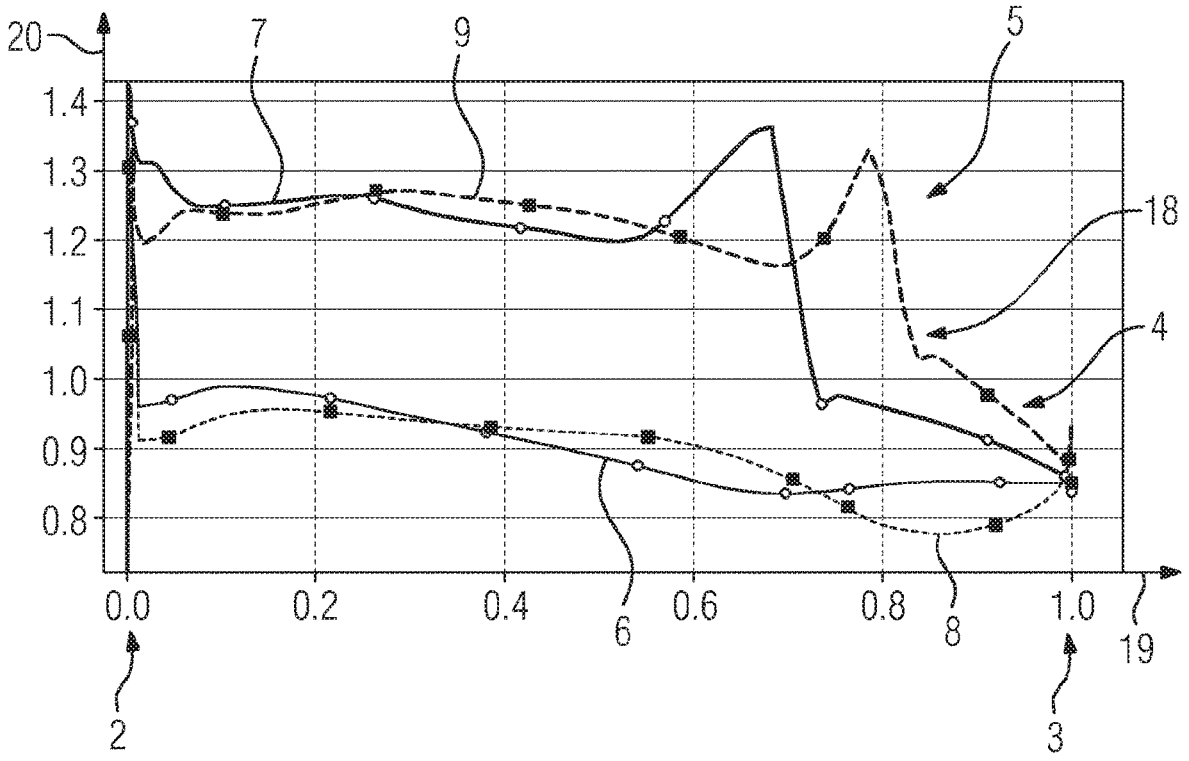
FIG. 5 shows the Mach number progressions from FIG. 2 with standardized lengths of the profile chords.

FIG. 5 shows the Mach number progressions from FIG. 2 in relation to the length of the profile chord 22. To this end, the Mach number progression of the compressor rotor blade 1 has been scaled in such a way that the front edge 2 and the rear edge 3 of the compressor rotor blade 1 coincide with the front edge and the rear edge of the conventional compressor rotor blade.

It can be seen from FIG. 2 that the Mach number progression 9 on the suction side 5 of the compressor rotor blade 1 directly upstream of the compression shock 18 has lower supersonic Mach numbers than the Mach number progression 7 on the suction side of the conventional compressor rotor blade directly upstream of the compression shock. Said lower supersonic Mach numbers are maintained over a longer extent along the profile chord 22 than in the case of the conventional compressor rotor blade. Losses are reduced as a result of the lower supersonic Mach numbers upstream of the compression shock 18. By virtue of the fact that the supersonic Mach numbers are maintained over the longer extent, the entire profile loading which correlates with the difference of the Mach numbers on the pressure side 4 and the suction side 5 is comparatively high in the subsonic region downstream of the compression shock 18, as in the case of the conventional compressor rotor blade. In addition, it can be seen from FIG. 1 that the compression shock 18 is arranged obliquely, which means that the compression shock 18 moves downstream as the spacing from the suction side 5 increases. This likewise leads to a reduction of losses. Furthermore, it can be gathered from FIG. 2 that the profile loading in the case of the compressor rotor blade 1 downstream of the compression shock 18 is considerably higher than in the case of the conventional compressor rotor blade. As a result of the reduced losses and as a result of higher profile loading in the subsonic region, a higher degree of efficiency can be achieved by way of the compressor rotor blade 1 than by way of the conventional compressor rotor blade. As a result of the higher degree of efficiency, the compressor rotor blade 1 (as shown in FIG. 2) can be of shorter configuration than the conventional compressor rotor blade, as a result of which losses by way of friction of the working medium on the compressor rotor blade 1 can be reduced.

Figure 4:
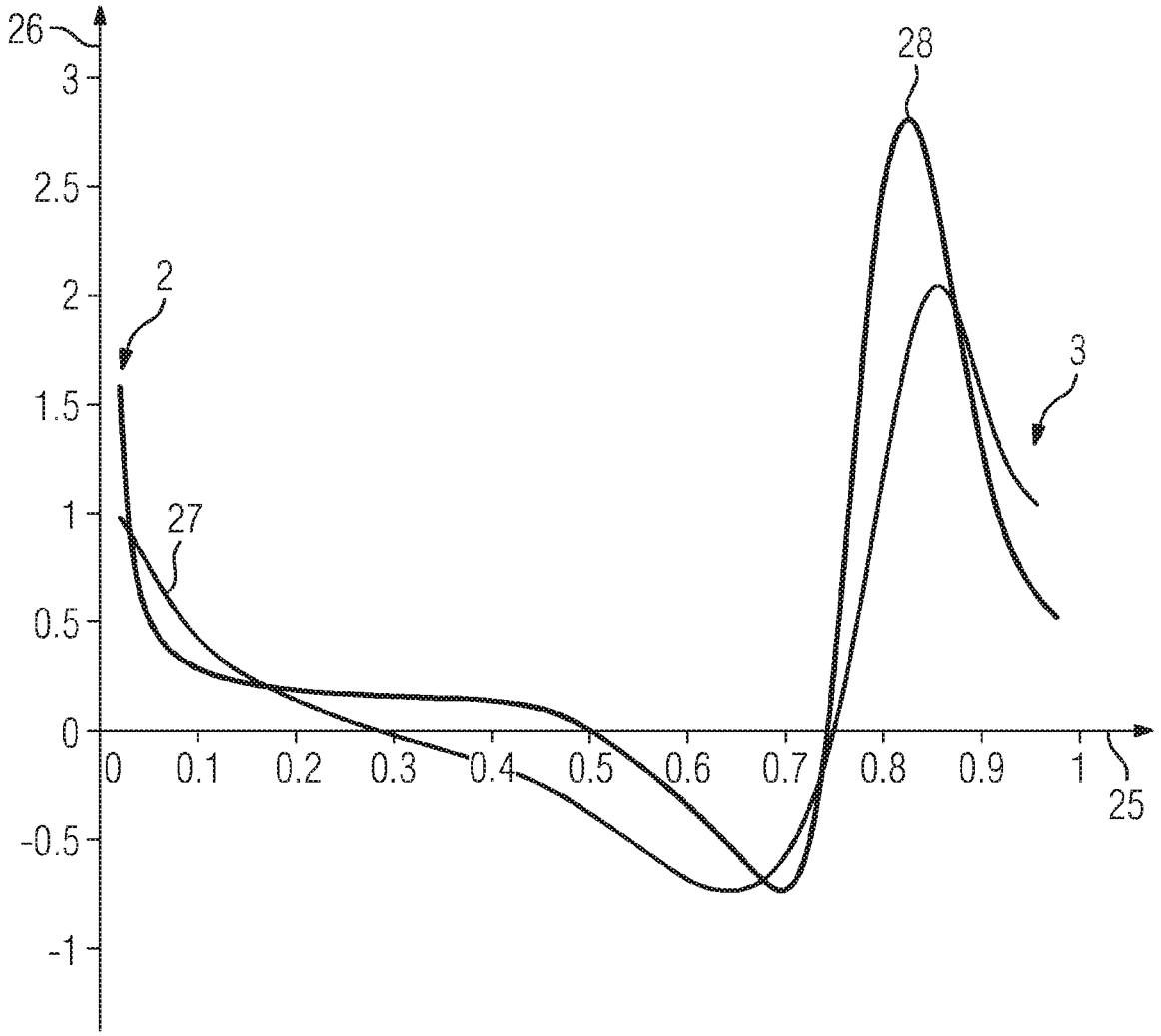
FIG. 4 shows curvature progressions on the compressor rotor blade according to the invention.

FIG. 4 shows a curvature progression 27 along the pressure side 4 and a curvature progression 28 along the suction side 5. The two curvature progressions 27, 28 are constant. The length of the profile chord 22 is plotted on the horizontal axis 25, and the curvature k multiplied by the length of the profile chord 22 is plotted on the vertical axis 26. The curvature k is defined as $$k = \lim_{\Delta s \to 0} \frac{\Delta\alpha}{\Delta s} = \frac{d\alpha}{ds},$$

wherein $\Delta s$ is the length of a circular arc, and $\Delta\alpha$ is the differential angle between the tangents at the end points of the circular arc.

Concave suction side regions and convex pressure side regions are distinguished by a negative sign in front of the curvature. Convex suction side regions and concave pressure side regions are distinguished by a positive sign in front of the curvature.

In the concave suction side region 10, the progression of the curvature multiplied by the length of the profile chord 22 has a minimum value which is from −1.2 to −0.5. On its suction side 5, the profile section 21 has a first convex suction side region 11 which is arranged downstream of the concave suction side region 10. On its suction side 5, the profile section 21 has a second convex suction side region 12 which is arranged upstream of the concave suction side region 10. In the convex suction side region 11, the progression of the curvature has a maximum value which is greater than the maximum value of the progression of the curvature in the corresponding region of the conventional compressor rotor blade; in particular, in the convex suction side region 11, the progression of the curvature multiplied by the length of the profile chord 22 has a maximum value which is from 2 to 4.

The point of the concave suction side region 10 with the minimum curvature in the case of a perpendicular projection onto the profile chord 22 of the profile section 21 defines a projection point 24 on said profile chord 22, which projection point 24 is spaced apart from the front edge of the profile section 21 by from 40% to 80% of the length of the profile chord 22. The point of the convex suction side region 11 with the maximum curvature in the case of a perpendicular projection onto the profile chord 22 of the profile section 21 defines a projection point 24 on said profile chord 22, which projection point 24 is spaced apart from the front edge of the profile section 21 by from 80% to 100% of the length of the profile chord 22. On its pressure side 4, the profile section 21 has a convex pressure side region 14 which is arranged in a region which is arranged so as to lie opposite the concave suction side region 10.

The compressor rotor blade 1 is to be profiled as follows by way of example: providing of a geometric model of the blade profile, the blade profile having a profile section 21 which extends in the transonic section and lies on a rotational surface, the axis of which coincides with the axis of the compressor, on a conical surface, the axis of which coincides with the axis of the compressor, on an $S_1$ flow surface of the compressor, or in a tangential plane of the compressor, and the rotor blade row 15 being set up such that, in the case of a nominal operating condition of the compressor, a compression shock 18 sets in, in the case of which the working medium is retarded from supersonic speed to subsonic speed; —fixing of boundary conditions for a flow which flows around the blade 14, 15 and occurs in the case of the nominal operating condition; —changing of the profile section 21 in such a way that merely the camber line is shifted, and the suction side 5 has a concave suction side region 10 and a convex suction side region 11 which is arranged downstream of the concave suction side region 10, and which, on its pressure side 4, has a convex pressure side region 14 and a concave pressure side region 13 which is arranged downstream of the convex pressure side region 14, a curvature progression 27 on the pressure side 4 of the profile section 21 and a curvature progression 28 on the suction side 5 of the profile section 21 being constant in each case plotted over a profile chord 22 of the profile section 21, the positions of the minimum values of the curvature progressions 27, 28 differing from one another by no more than 10% of the length of the profile chord 22, and the positions of the maximum values of the curvature progressions 27, 28 differing from one another by no more than 10% of the length of the profile chord 22, the minimum values multiplied by the length of the profile chord (22) being from −1.2 to −0.5, and the maximum values multiplied by the length of the profile chord 22 being from 1.5 to 4, the convex suction side region 11 being arranged at least partially upstream of a compression shock 18 which is exhibited by a flow which sets in in the compressor in the case of the boundary conditions, as a result of which, in relation to the length of the profile chord 22, the compression shock 18 is arranged downstream of a compression shock which a flow would exhibit which would set in in the case of the geometric model before the profile section is changed and in the case of the nominal operating condition.

It can be determined computationally, in particular by way of a finite volume method, or experimentally whether the compression shock 18 shifts downstream as a result of the change in the profile section.

Although the invention has been illustrated more clearly and described in detail by way of the preferred exemplary embodiment, the invention is not restricted to the disclosed examples, and other variations can be derived therefrom by a person skilled in the art without departing from the scope of protection of the invention.

The invention claimed is:

1. A compressor rotor blade for a compressor of axial design, comprising:

a blade profile which comprises a transonic section, and a profile section of the blade profile, wherein the profile section extends in the transonic section and, on a suction side comprises a concave suction side region and a convex suction side region which is arranged downstream of the concave suction side region, and wherein, on a pressure side comprises a convex pressure side region and a concave pressure side region which is arranged downstream of the convex pressure side region, a progression of a curvature on the pressure side of the profile section and a progression of a curvature on the suction side of the profile section being continuous in each case plotted over a profile chord of the profile section, wherein over the profile chord positions of minimum values of the progression of the curvature differ from one another by no more than 10% of a length of the profile chord, and over the profile chord positions of maximum values of the progression of the curvature differ from one another by no more than 10% of the length of the profile chord, the minimum values of the progression of the curvature multiplied by the length of the profile chord being from −1.2 to −0.5, and the maximum values of the progression of the curvature multiplied by the length of the profile chord being from 1.5 to 4.

2. The compressor rotor blade as claimed in claim 1, wherein the progression of the curvature multiplied by the length of the profile chord comprises a maximum value which is from 2 to 4 in the convex suction side region, and the progression of the curvature multiplied by the length of the profile chord comprises a maximum value which is from 1.5 to 2.5 in the concave pressure side region.

3. The compressor rotor blade as claimed in claim 1, wherein a point of the concave suction side region with a minimum curvature in the case of a perpendicular projection onto the profile chord of the profile section defines a projection point on said profile chord, which projection point is spaced apart from a front edge of the profile section by from 40% to 80% of the length of the profile chord.

4. The compressor rotor blade as claimed in claim 1, wherein a thickness of the profile section perpendicularly with respect to the profile chord is shorter than 2.5% of the length of the profile chord.

5. A compressor for compressing a working medium, comprising:

a rotor blade row which comprises compressor rotor blades as claimed in claim 1, wherein the rotor blade row is set up such that, in the case of a nominal operating condition of the compressor, a precompression of the working medium takes place upstream of a compression shock, at which the working medium is retarded from supersonic speed to subsonic speed, and upstream of a flow duct which is delimited by two adjacent compressor rotor blades.

6. A method for profiling a compressor rotor blade for a compressor for compressing a working medium of axial design, which compressor comprises a rotor blade row with the compressor rotor blades, the compressor rotor blades comprising a blade profile with a transonic section, the method comprising:

providing a geometric model of the blade profile, the blade profile comprising a profile section which extends in the transonic section, and the rotor blade row being set up such that, in a case of a nominal operating condition of the compressor, a compression shock sets in, at which the working medium is retarded from supersonic speed to subsonic speed;

fixing of boundary conditions for a flow which flows around the compressor rotor blade and occurs in the case of the nominal operating condition; and changing of the profile section in such a way that a suction side comprises a concave suction side region and a convex suction side region which is arranged downstream of the concave suction side region, and which, on a pressure side, comprises a convex pressure side region and a concave pressure side region which is arranged downstream of the convex pressure side region, a progression of a curvature on the pressure side of the profile section and a progression of a curvature on the suction side of the profile section being continuous in each case plotted over a profile chord of the profile section, over the profile chord positions of minimum values of the progression of the curvature differing from one another by no more than 10% of a length of the profile chord, and over the profile chord positions of maximum values of the progression of the curvature differing from one another by no more than 10% of the length of the profile chord, the minimum values of the progression of the curvature multiplied by the length of the profile chord being from −1.2 to −0.5, and the maximum values of the progression of the curvature multiplied by the length of the profile chord being from 1.5 to 4, the convex suction side region being arranged at least partially upstream of a compression shock which is exhibited by a flow which sets in the compressor in the case of the boundary conditions, as a result of which, in relation to the length of the profile chord, the compression shock is arranged downstream of a compression shock which would be exhibited by a flow which would set in the case of the geometric model before the profile section is changed and in the case of the nominal operating condition.

7. The method as claimed in claim 6, wherein the profile section is lying on a cylindrical surface, an axis of which coincides with an axis of the compressor, on a conical surface, an axis of which coincides with the axis of the compressor, on an S1 flow surface of the compressor, or in a tangential plane of the compressor.

8. The method as claimed in claim 6, wherein a camber line of the profile section is shifted when said profile section is changed.

9. The method as claimed in claim 6, wherein the geometric model, before a change of the profile section, is of exclusively concave configuration on the pressure side of said profile section and/or is of exclusively convex configuration on the suction side of said profile section.

10. The method as claimed in claim 6, wherein the profile section is changed in such a way that the progression of the curvature comprises a maximum value in the convex suction side region, which maximum value is greater than a maximum value of the progression of the curvature in a corresponding region of a conventional compressor rotor blade.

11. The method as claimed in claim 6, wherein the profile section is changed in such a way that the progression of the curvature multiplied by the length of the profile chord comprises a maximum value which is from 2 to 4 in the convex suction side region, and the progression of the curvature multiplied by the length of the profile chord comprises a maximum value which is from 1.5 to 2.5 in the concave pressure side region.

12. The method as claimed in claim 6, wherein the profile section is changed in such a way that a point of the concave suction side region with a minimum curvature in the case of a perpendicular projection onto the profile chord of the profile section defines a projection point on said profile chord, which projection point is spaced apart from a front edge of the profile section by from 40% to 80% of the length of the profile chord.

13. The method as claimed in claim 6, wherein the rotor blade row is designed in such a way that it comprises a maximum isentropic Mach number of at most 1.4.

14. The method as claimed in claim 6, wherein the profile section is designed in such a way that a thickness of the profile section perpendicularly with respect to the profile chord is shorter than 2.5% of the length of the profile chord.

15. The method as claimed in claim 8, wherein only the camber line is shifted.

16. The method as claimed in claim 13, wherein the rotor blade row is designed in such a way that it comprises the maximum isentropic Mach number of at most 1.3, in the case of the nominal operating condition.

* * * * *